US006059548A

United States Patent [19]

Campbell et al.

[11] Patent Number: 6,059,548

[45] Date of Patent: May 9, 2000

[54] HAND PUMP SYSTEM FOR A TRACTION DEVICE

[75] Inventors: Glenn M. Campbell, Maple Grove; Douglas Kluge, Clearwater, both of Minn.

[73] Assignee: The Saunders Group, Inc., Chaska, Minn.

[21] Appl. No.: 09/092,451

[22] Filed: Jun. 5, 1998

[51] Int. Cl.[7] ..... F04B 39/10

[52] U.S. Cl. ..... 417/555.1; 417/434

[58] Field of Search ..... 417/63, 434, 435, 417/440, 555.1

[56] References Cited

U.S. PATENT DOCUMENTS

| | | |
|---|---|---|
| 1,205,649 | 11/1916 | Miller . |
| 2,910,061 | 10/1959 | Rabjohn . |
| 3,847,146 | 11/1974 | Cushman . |
| 3,888,243 | 6/1975 | Powlan . |
| 3,937,216 | 2/1976 | Brown . |
| 4,146,021 | 3/1979 | Brosseau et al. . |
| 4,242,946 | 1/1981 | Toliusis . |
| 4,320,749 | 3/1982 | Highley . |
| 4,428,276 | 1/1984 | Loveless . |
| 4,583,532 | 4/1986 | Jones . |
| 4,649,907 | 3/1987 | Whitehead et al. . |
| 4,669,455 | 6/1987 | Bellati . |
| 4,995,378 | 2/1991 | Dryer et al. . |
| 5,067,483 | 11/1991 | Freed . |
| 5,092,322 | 3/1992 | Gantz . |
| 5,169,160 | 12/1992 | Gaskill et al. . |
| 5,181,904 | 1/1993 | Cook et al. . |
| 5,360,392 | 11/1994 | McCoy . |
| 5,382,226 | 1/1995 | Graham . |
| 5,653,678 | 8/1997 | Fulk . |
| 5,722,941 | 3/1998 | Hart . |

*Primary Examiner*—Henry Bennett
*Assistant Examiner*—Derek Boles
*Attorney, Agent, or Firm*—Faegre & Benson LLP

[57] ABSTRACT

A hand pump system for pressurizing and de-pressurizing a pneumatic cylinder on a traction device. The hand pump system includes a hand pump having a pump head with a vent hole. A flow control assembly has a stem portion extending into the pump head. The stem portion has a primary chamber fluidly coupled to the pneumatic cylinder and a stem passageway extending through the stem portion. The housing is rotatable within the pump head between a pump position fluidly coupling the stem passageway with the pump; to a release position fluidly coupling the stem passageway with the vent hole; and to a positive shut off position to seal the vent hole with a vent seal and to seal the stem passageway with a pump seal. A pressure gauge is included in the flow control assembly fluidly coupled to the primary chamber.

11 Claims, 8 Drawing Sheets

Fig. 2
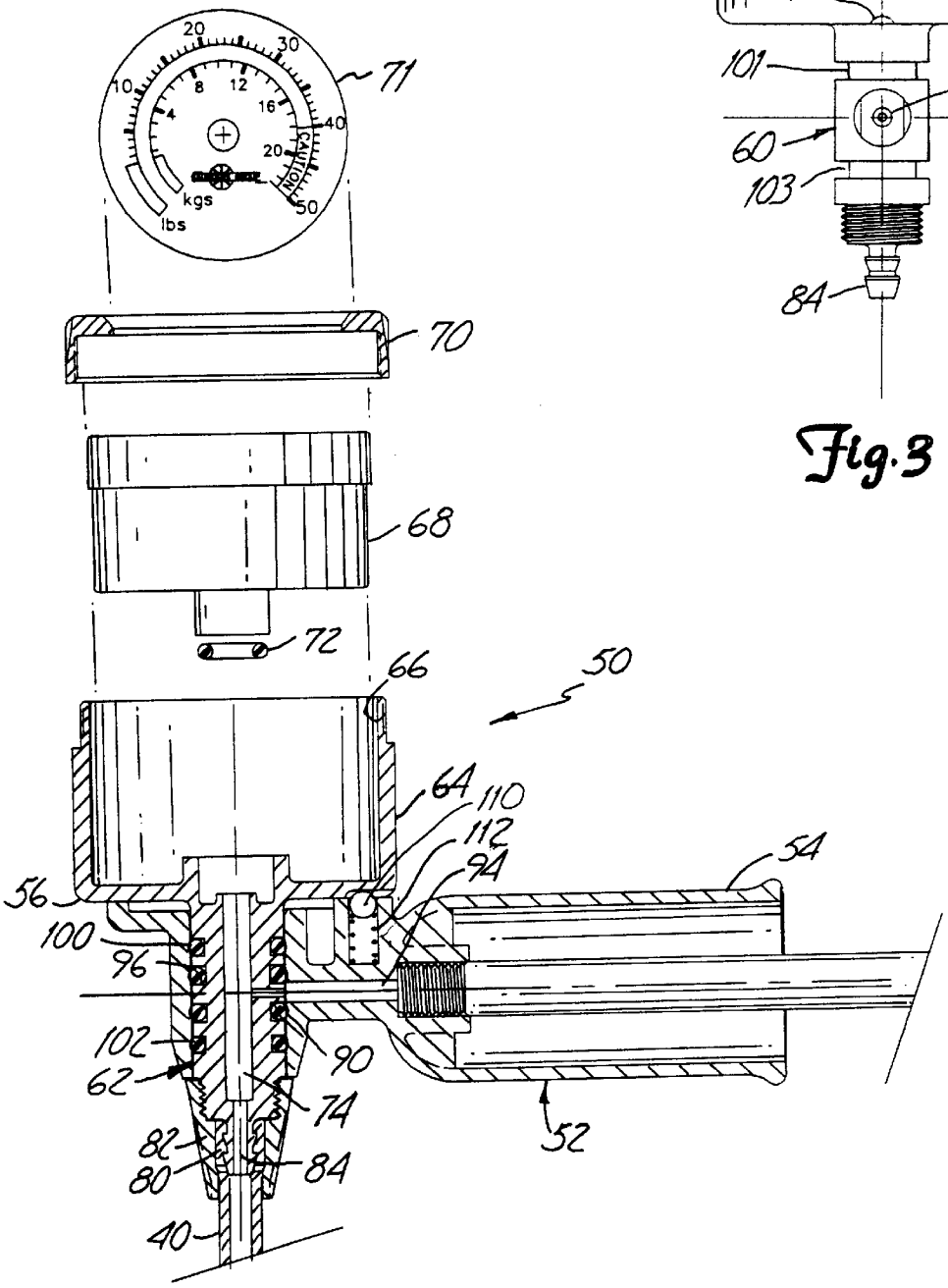
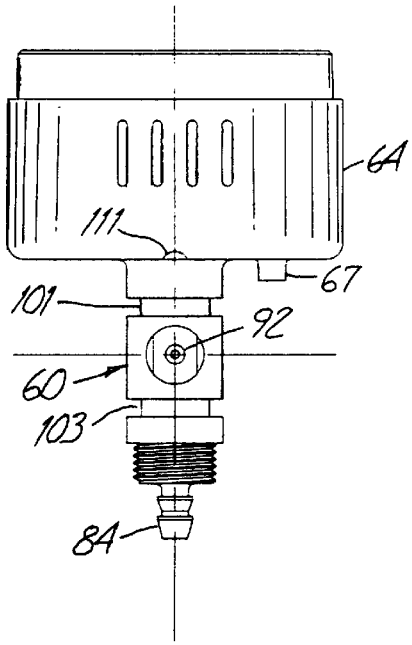
Fig. 3

HAND PUMP SYSTEM FOR A TRACTION DEVICE

FIELD OF THE INVENTION

The present invention is directed to a hand pump system for pressurizing and de-pressurizing a pneumatic cylinder on a traction device.

BACKGROUND OF THE INVENTION

Traction is widely used to relieve pressure on inflamed or enlarged nerves. While traction is applicable to any part of the body, cervical and lumbar or spinal traction are the most common. When correctly performed, spinal traction can cause distraction or separation of the vertebral bodies, a combination of distraction and gliding of the facet joints, tensing of the ligamentous structures of the spinal segment, widening of the intervertebral foramen, straightening of spinal curvature and stretching of the spinal musculature. Depending on the injury being treated, the traction component of physical therapy may require multiple sessions per week for a prolonged period of time.

Cervical traction requires a traction force up to approximately 222 N (50 lbs.). Lumbar traction typically requires force equal to half of the patient's bodyweight, or about 333–667 N (75–150 lbs.). The equipment necessary for performing traction, however, has typically been expensive and thus only available to a patient in a therapist's office.

A number of portable traction devices utilize pneumatic or hydraulic cylinders to create the traction force. Hydraulic cylinders have the disadvantage of the weight of the hydraulic fluid. Pneumatic cylinders with low pressure inputs typically can not maintain an adequate traction force for a sufficient period of time to be effective in a traction device. In an attempt to overcome this deficiency, some of these devices utilize an automatic pumping device triggered by a pressure sensing device to supply additional compressed air so that a constant level of traction force is maintained. These pump and sensor configurations add cost, weight and complexity to the traction device.

The air input pumps used on some traction devices also exhibit a number of shortcomings. For example, bulb-type air pumps produce relatively small input pressures. A small female patient can generate only about 483 kPa (7 psi) of pressure using a bulb-type pump. Consequently, small input pressure devices require large diameter cylinders to generate the necessary output traction forces. Larger diameter cylinders, when used with low pressure input devices, are more prone to leak, thereby further complicating the problem of maintaining a constant traction force for a prolonged period of time.

The air input pump can also be a source of leakage for the system. Since some traction therapies are performed at relatively low pressures (e.g., 20 to 30 psi), conventional check valves may be ineffective for maintaining a static traction force for a prolonged period of time. Therefore, what is needed is a low-cost, light weight pneumatic pump that resists the leakage of air even at low pressures.

SUMMARY OF THE INVENTION

The present invention is directed to a hand pump system for pressurizing and de-pressurizing a pneumatic cylinder on a traction device. The hand pump system includes a hand pump having a pump head with a vent hole. A flow control assembly is integrally formed with the hand pump. The flow control assembly comprises a housing having a stem portion extending into the pump head. The stem portion has a primary chamber fluidly coupled to the pneumatic cylinder and a stem passageway extending through the stem portion. The housing is rotatable within the pump head between a pump position fluidly coupling the stem passageway with the pump; to a release position fluidly coupling the stem passageway with the vent hole; and to a positive shut off position to seal the vent hole with a vent seal and to seal the stem passageway with a pump seal. A pressure gauge is included in the flow control assembly fluidly coupled to the primary chamber.

In one embodiment, the pump seal forms a sealing engagement between the stem passageway and the pump inlet in the pump position. An upper seal is located between the stem portion and the pump head above the stem portion passageway and the vent hole. A lower seal is located between the stem portion and the pump head below the stem passageway and the vent hole. The upper and lower stem seals define a stem chamber. The pump head and the hand pump preferably comprise a unitary structure. In one embodiment, a detent system is provided for locating the rotating housing in the pump position. The hand pump system of the present invention preferably leaks less than 6.9 kPa (1 psi) over a period of 30 minutes when fluidly coupled to a pneumatic cylinder having a chamber of at least 442.5 centimeters$^3$ (3 inches$^3$) and an initial pressure of at least 172.3 kPa (25 psi).

BRIEF DESCRIPTION OF THE SEVERAL VIEWS OF THE DRAWING

FIG. 2 is an exploded cross sectional view of a hand pump system in accordance with the present invention.

FIG. 3 is a side view of a gauge housing for use in the hand pump system of the present invention.

DETAILED DESCRIPTION OF THE INVENTION

Figure 1:
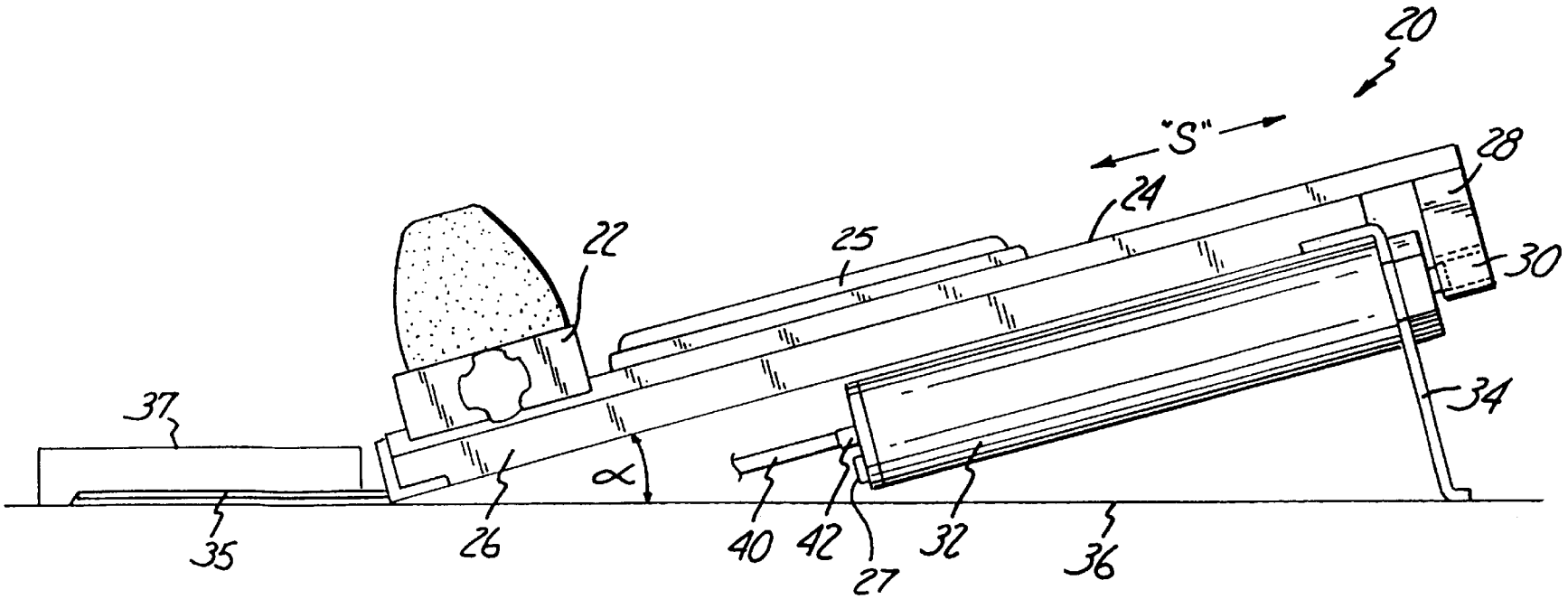
FIG. 1 is a side view of a portable traction device.
Figure 6:
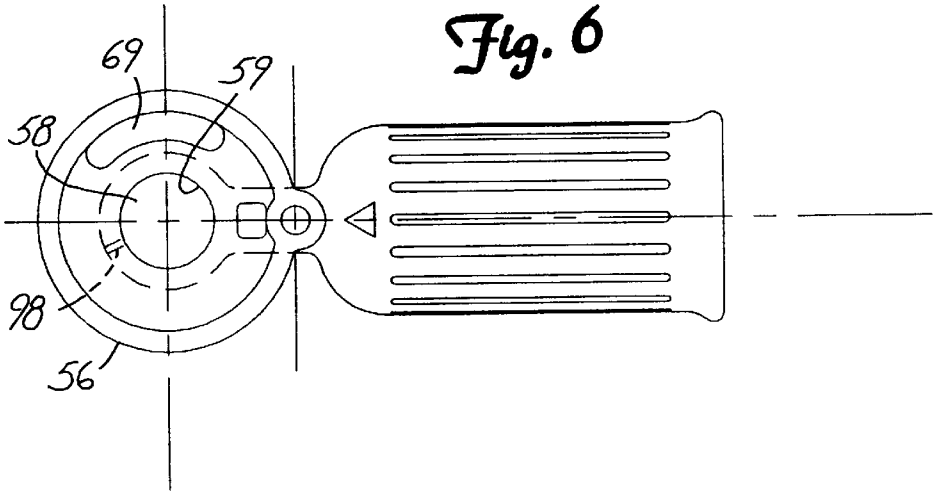
FIG. 6 is a top view of a pump handle for the hand pump system of FIG. 2.
Figure 7:
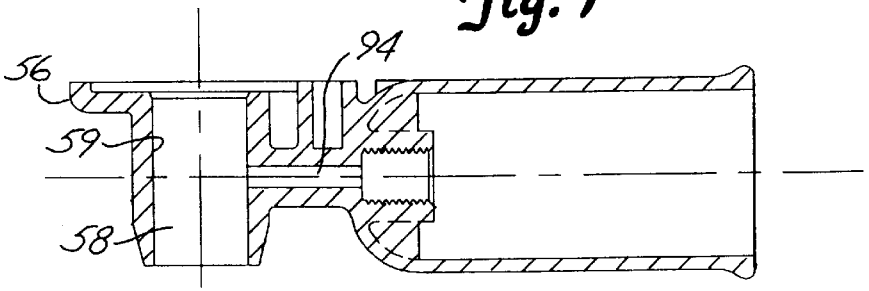
FIG. 7 is a side sectional view of the pump handle for the hand pump system of FIG. 2.
Figure 4:
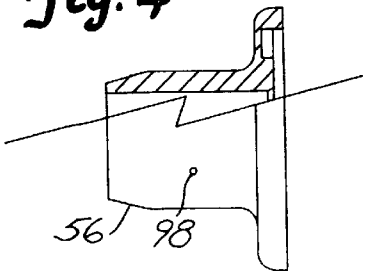
FIG. 4 is a side view of a pump head for the hand pump system of FIG. 2.
Figure 5:
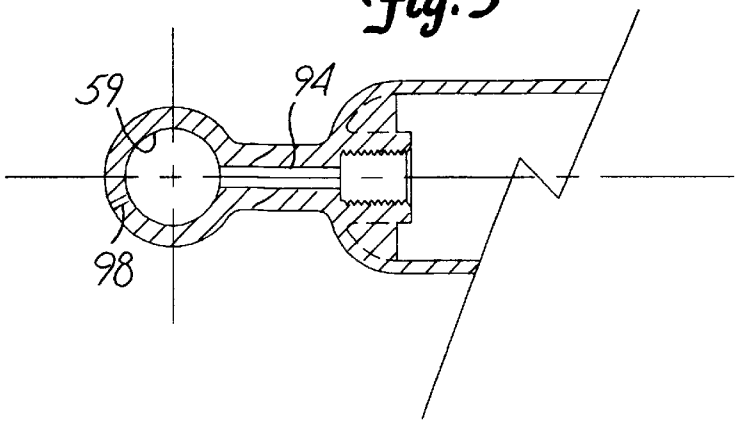
FIG. 5 is a top sectional view of a pump handle for the hand pump system of FIG. 2.

FIG. 1 illustrates an exemplary portable, cervical traction device 20 for use with the hand pump system 50 in accordance with the present invention (see FIG. 2). The traction device 20 includes a carriage 22 and a sliding portion 24 having a head support pad 25 that are allowed to move freely along a track 26 in a direction "S". The slide portion 24 includes a slide bracket 28 that engages with a piston rod 30 of a pneumatic cylinder 32 mounted underneath the track 26. The track 26, carriage 22, and slide portion 24 are preferably constructed of a light weight, low-cost material, such as aluminum, steel, high density plastic, or a variety of composite materials. A removable stabilizer bracket 35 is added to prevent the support bracket 34 from lifting off of the support surface 36 during use. A pad 37 preferably is placed over the support bracket 36 for the comfort of the user.

The pneumatic cylinder 32 is attached to the track 26 by an angle bracket 34. An air line 40 is attached to an air inlet 42 at one end of the cylinder 32 for providing pressurized air to the cylinder 32. An adjustable pressure regulator 27 is included on the cylinder 32 to prevent over-pressure conditions. The present hand pump system 50 may be used with a variety of traction devices such as those disclosed in commonly assigned U.S. patent application Ser. No. 08/817,444, entitled portable traction device, and U.S. Pat. No. RE. 32,791.

Figure 11:
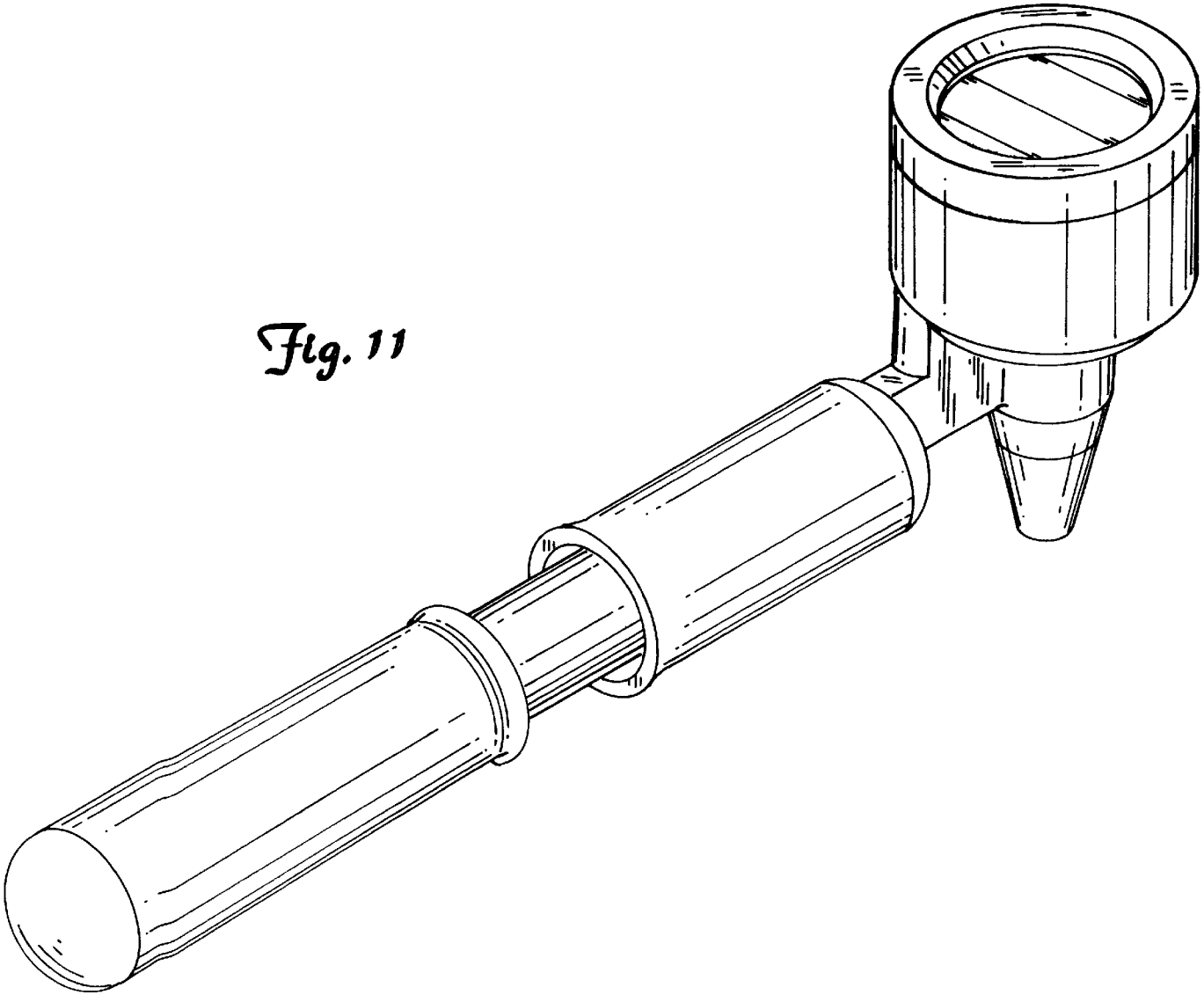
FIG. 11 is a view in perspective of a hand pump in accordance with the present invention.
Figure 12:
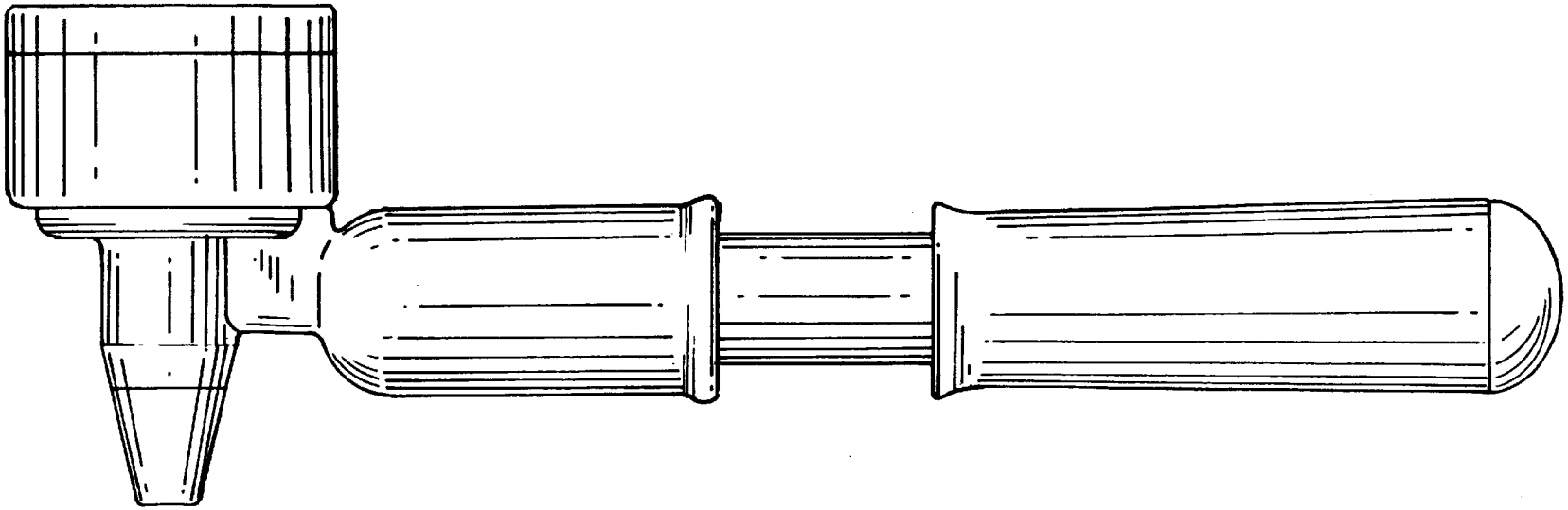
FIG. 12 is a side plan view of the hand pump of FIG. 11.
Figure 13:
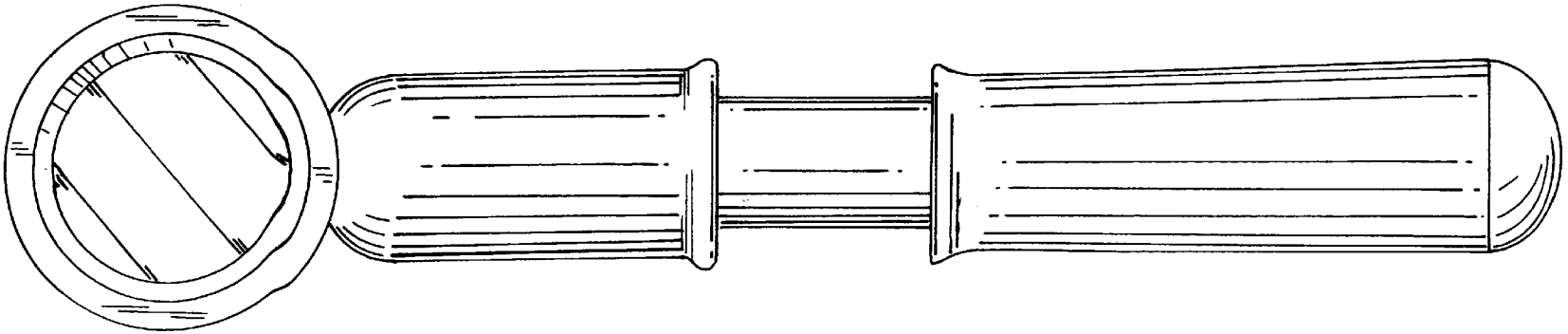
FIG. 13 is a top view of the hand pump of FIG. 11.
Figure 14:
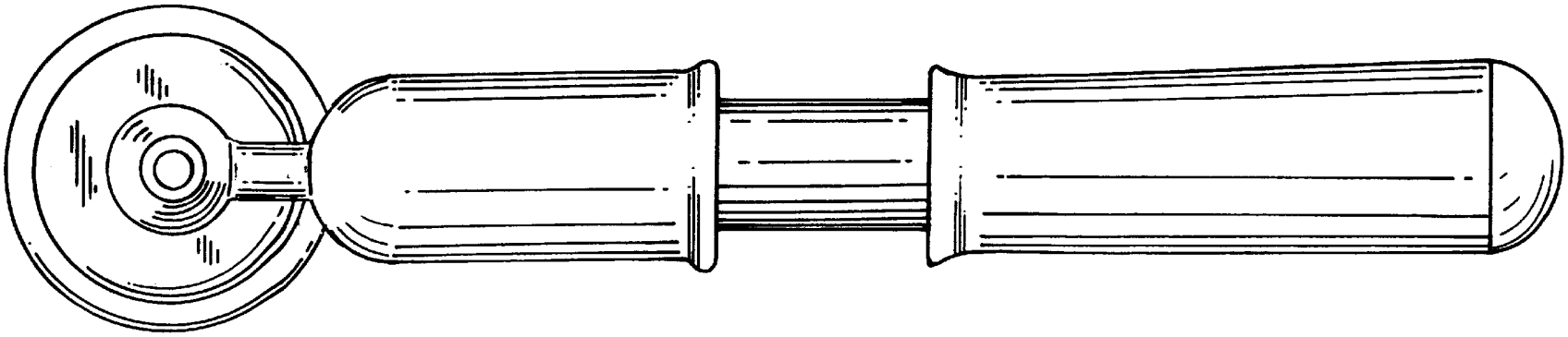
FIG. 14 is a bottom plan view of the hand pump of FIG. 11.
Figure 16:
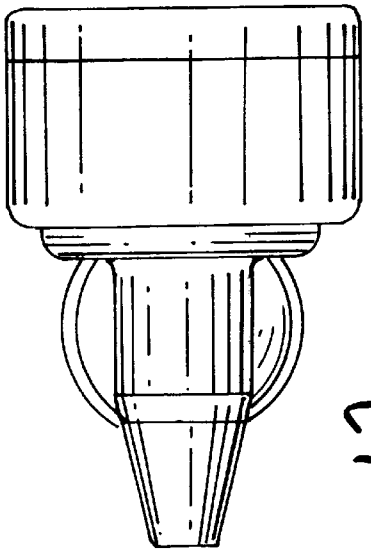
FIG. 16 is an end view of the hand pump of FIG. 11.
Figure 15:
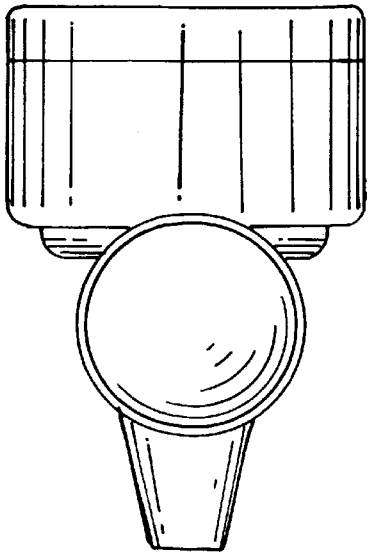
FIG. 15 is an end view of the hand pump of FIG. 11.

FIGS. 2 through 7 illustrate various aspects of the hand pump system 50 in accordance with the present invention. Hand pump 52 includes a handle 53 (see FIG. 11) at one end and a barrel 54 and pump head 56 at the other end. The pump head 56 has an inner surface 59 defining a center bore 58 for receiving a stem portion 60 of a flow control assembly 62. The stem portion 60 is preferably integrally formed with a gauge housing 64.

The gauge housing 64 has a recess 66 for receiving a pressure gauge 68. Tab 67 is located on the housing 64 to engage with slot 69 on the pump head 56. The slot 69 limits the rotational movement of the flow control assembly 62 within the pump head 56. A housing end cap 70 preferably seals the pressure gauge 68 and the gauge face 71 into the gauge housing 64. A seal 72 is provided at the interface between the pressure gauge 68 and a primary chamber 74 formed in the center of the stem portion 60.

The primary chamber 74 fluidly couples the pressure gauge 68 with the hose 40 connected to the pneumatic cylinder 32. The hose 40 preferably includes a flange 80 configured to engage with a hose fitting 82 around a hose connector 84. The components 80, 82, and 84 rotate with the flow control assembly 62 during operation of the pump system 50.

Figure 8:
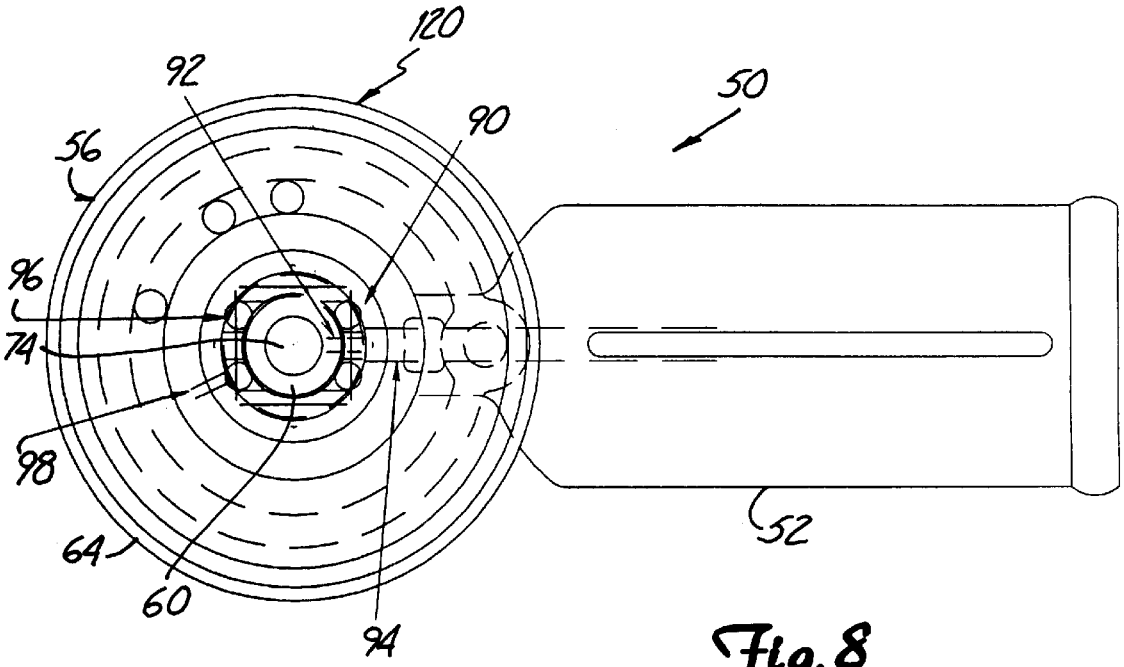
FIG. 8 is a schematic illustration of a hand pump system in accordance with the present invention in the pump position.

The stem portion 60 includes a pump seal 90 extending around a stem passageway 92 that fluidly couples the primary chamber 74 with a pump inlet 94 when the hand pump system 50 is in the pump position 120 (see FIG. 8). A vent seal 96 is located on the stem portion 60 proximate a vent 98 on the pump head 56 (see FIG. 4 through 6).

An upper stem seal 100 extends around the circumference of the stem portion 60 in a recess 101 above the stem passageway 92 and vent 98. A lower stem seal 102 extends circumferentially around the stem portion 60 in a recess 103 below the stem passageway 92 and vent 98. A stem chamber 104 (see FIG. 10) is formed between the inner surface 59 and the stem portion 60, above and below the seals 102, 100, respectively.

A detent ball 110 is biased by a detent spring 112 against the gauge housing 64. A recess 11 is provided positive registration for the pump position 120. As will be discussed in detail below, the gauge housing 64, stem portion 60, and hose fitting 82 can be rotated within the pump head 56 in order to configure the hand pump system 50 in a pump position 120, a positive shut-off position 122, and a release position 124.

FIG. 8 is a schematic illustration of the hand pump system 50 in a pump position 120. The gauge housing 64 is rotated so that the stem passageway 92 is fluidly coupled to the pump inlet 94. The vent seal 96 is positioned to engage with the vent 98. The pump seal 90 forms a sealing engagement around the stem passageway 92 between the stem portion 60 and the pump head 56. In the pump position 120, pressurized air from the hand pump 52 is forced through the stem passageway 92 into the primary chamber 74. The pressure gauge 68 is fluidly coupled to the primary chamber 74 at all times so that pressure in the pneumatic cylinder 32 is reflected on the gauge face 71.

Figure 9:
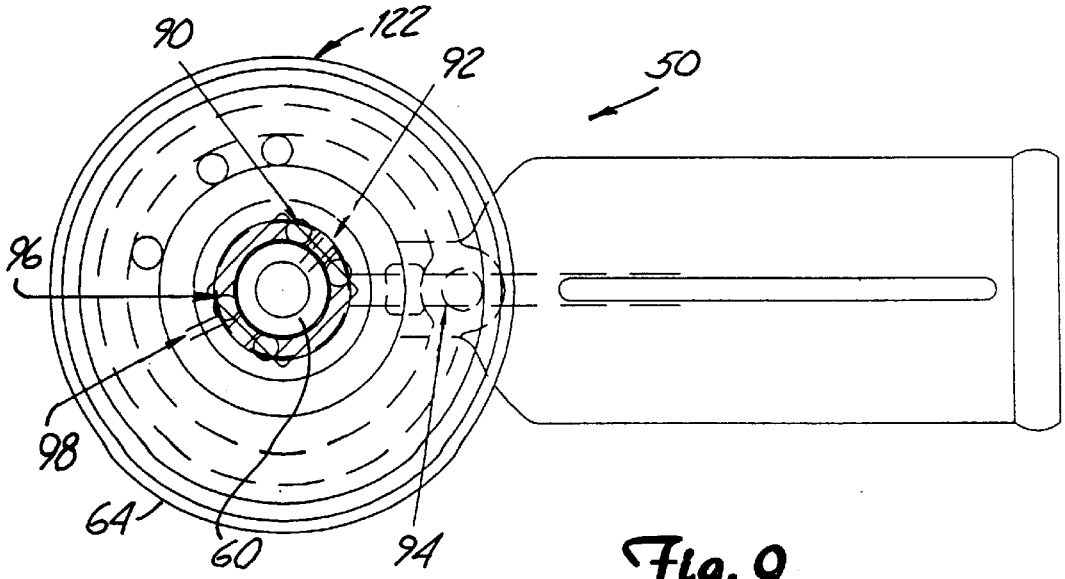
FIG. 9 is a schematic illustration of the hand pump system in accordance with the present invention in the positive shut off position.

FIG. 9 is a schematic illustration of the hand pump system 50 in the positive shut off position 122. Positive shut-off refers to a valve, seal or other means for closing a flow path, that is not dependent upon pressure in the system for maintaining the closure. The gauge housing 64 is rotated counter-clockwise so that the stem passageway 92 is no longer fluidly coupled to the pump inlet 94. In the positive shut off position 122, the pump seal 90 surrounds the stem passageway 92 and forms a sealing engagement between the stem portion 60 and the inner surface 59 of the center bore 58 in the pump head 56. Simultaneously, the vent seal 96 continues to obstruct the vent 98. In the positive shut off position 122, the present hand pump system 50 can maintain a static pressure in the pneumatic cylinder 32 for an extended period of time. In one embodiment, the hand pump system 50 leaks less than 6.9 kPa (1 psi) over a period of 30 minutes when fluidly coupled to a pneumatic cylinder having a chamber of at least 442.5 centimeters$^3$ (3 inches$^3$) and an initial pressure of at least 172.3 kPa (25 psi).

Figure 10:
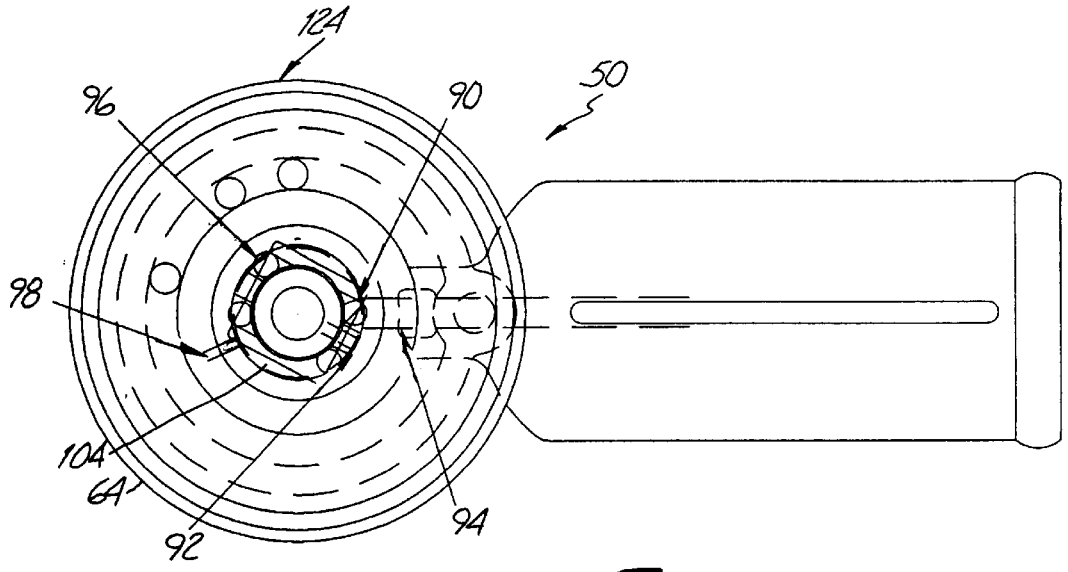
FIG. 10 is a schematic illustration of the hand pump system in accordance with the present invention in the release position.

FIG. 10 is a schematic illustration of the present hand pump system 50 in the released position 124. The gauge housing 64 is rotated clockwise so that the pump seal 90 extends across the pump inlet 94 to fluidly couple the primary chamber 74 with the stem chamber 104. Simultaneously, the vent seal 96 is rotated past the vent 98, exposing it to pressurized air in the stem chamber 104. In the release position 124, pressurized air in the primary chamber 74 moves through the stem passageway 92 into the stem chamber 104, and finally through the vent 98. The size of the vent 98 permits a controlled release of pressure in the cylinder 32. In the illustrated embodiment, the vent 98 is 0.8 millimeters (0.032 inches).

FIGS. 1–16 illustrate various views of a hand pump in accordance with the present invention.

The complete disclosures of all patents, patent applications, and publications are incorporated herein by reference as if individually incorporated. Various modifications and alterations of this invention will become apparent to those skilled in the art without departing from the scope and spirit of this invention, and it should be understood that this invention is not to be unduly limited to the illustrative embodiments set forth herein.

What is claimed is:

1. A hand pump system for pressurizing and de-pressurizing a pneumatic cylinder on a traction device, the hand pump system comprising:

a hand pump having a pump head with a vent hole; and a flow control assembly having a stem extending into the pump head, the stem having a primary chamber for fluidly coupling to the pneumatic cylinder and a stem passageway extending through the stem and fluidly coupled with the primary chamber, the place pump head being rotatably to a pump position fluidly coupling the stem passageway with the pump, to a release position fluidly coupling the stem passageway with the vent hole, and to a positive shut-off position sealing the vent hole with a vent seal and sealing the stem passageway with a pump seal.

2. The hand pump of claim 1 further comprising a pressure gauge integral with the flow control assembly and fluidly coupled to the primary chamber.

3. The hand pump system of claim 1 wherein the pump seal forms a sealing engagement between the stem passageway and the pump inlet in the pump position.

4. The hand pump system of claim 1 wherein the flow control assembly further comprises;

an upper stem seal located between the stem and the pump head above the stem passageway and the vent hole; and an lower stem seal located between the stem and the pump head below the stem passageway and the vent hole, the upper and lower stem seals defining a stem chamber.

5. The hand pump system of claim 1 wherein the pump head and portions of the hand pump comprise a unitary structure.

6. The hand pump system of claim 1 further comprising a detent for locating the rotating housing in the pump position.

7. The hand pump system of claim 1 wherein the hand pump leaks less than 6.9 kPa (1 psi) over a period of 30 minutes when fluidly coupled to a pneumatic cylinder having a chamber of at least 442.5 centimeters$^3$ (3 inches$^3$) and an initial pressure of at least 172.3 kPa (25 psi).

8. The hand pump system of claim 1 wherein the pump position is located between the release position and the positive shut-off position.

9. The hand pump system of claim 1 further comprising a tab and slot combination to limit the rotational movement of the flow control assembly within the pump head.

10. A traction device fluidly coupled to the hand pump system of claim 1.

11. A hand pump system for pressurizing and de-pressurizing a pneumatic cylinder on a traction device, the hand pump system comprising:

a hand pump having a pump head with a vent hole;

a flow control assembly having a stem extending into the pump head, the stem having a primary chamber for fluidly coupling to the pneumatic cylinder and a stem passageway extending through the stem and fluidly coupled with the primary chamber, the housing being rotatably to at least three discrete positions;

a pump position fluidly coupling the stem passageway with the pump to pressurized the pneumatic cylinder;

a release position fluidly coupling the stem passageway with the vent hole to de-pressurize the pneumatic cylinder;

a positive shut-off position sealing the vent hole with a vent seal and sealing the stem passageway with a pump seal to retain pressure within the pneumatic cylinder; and a pressure gauge integral with the flow control assembly and fluidly coupled to the primary chamber.

* * * * *